US008210822B2

(12) United States Patent
DeMania et al.

(10) Patent No.: US 8,210,822 B2
(45) Date of Patent: Jul. 3, 2012

(54) DOVETAIL FOR STEAM TURBINE ROTATING BLADE AND ROTOR WHEEL

(75) Inventors: Alan Richard DeMania, Niskayuna, NY (US); Steven Michael DeLessio, Madison, AL (US)

(73) Assignee: General Electric Company, Schenectady, NY (US)

( * ) Notice: Subject to any disclaimer, the term of this patent is extended or adjusted under 35 U.S.C. 154(b) by 823 days.

(21) Appl. No.: 12/205,939

(22) Filed: Sep. 8, 2008

(65) Prior Publication Data

US 2010/0061859 A1 Mar. 11, 2010

(51) Int. Cl.
*B64C 11/04* (2006.01)

(52) U.S. Cl. ..... 416/219 R; 416/223 R

(58) Field of Classification Search ..... 416/217, 416/218

See application file for complete search history.

(56) References Cited

U.S. PATENT DOCUMENTS

| | | | | |
|---|---|---|---|---|
| 4,260,331 | A | 4/1981 | Goodwin | |
| 5,067,876 | A | 11/1991 | Moreman, III | |
| 5,174,720 | A | 12/1992 | Gradl | |
| 5,267,834 | A | 12/1993 | Dinh et al. | |
| 5,277,549 | A | 1/1994 | Chen et al. | |
| 5,299,915 | A | 4/1994 | Dinh et al. | |
| 5,393,200 | A | 2/1995 | Dinh et al. | |
| 5,480,285 | A | 1/1996 | Patel et al. | |
| 5,494,408 | A | 2/1996 | Seeley et al. | |
| 5,531,569 | A | 7/1996 | Seeley | |
| 5,829,955 | A | 11/1998 | Saito et al. | |
| 6,142,737 | A | 11/2000 | Seeley et al. | |
| 6,435,833 | B1 | 8/2002 | Reluzco et al. | |
| 6,435,834 | B1 | 8/2002 | Reluzco et al. | |
| 6,568,908 | B2 | 5/2003 | Namura et al. | |
| 6,575,700 | B2 | 6/2003 | Arai et al. | |
| 6,652,237 | B2 | 11/2003 | Yehle et al. | |
| 6,682,306 | B2 | 1/2004 | Murakami et al. | |
| 6,814,543 | B2 | 11/2004 | Barb et al. | |
| 6,846,160 | B2 | 1/2005 | Saito et al. | |
| 6,851,926 | B2 | 2/2005 | Guinessine et al. | |
| 6,893,216 | B2 | 5/2005 | Snook et al. | |
| 7,097,428 | B2 | 8/2006 | Barb et al. | |
| 7,195,455 | B2 | 3/2007 | Stonitsch et al. | |
| 7,632,072 | B2 | 12/2009 | Sheffield | |
| 2004/0120819 | A1 | 6/2004 | Gazzillo et al. | |
| 2005/0175462 | A1* | 8/2005 | Lagrange et al. | 416/219 R |
| 2007/0292265 | A1 | 12/2007 | Burdgick et al. | |
| 2009/0022591 | A1* | 1/2009 | Mujezinovic et al. | 416/219 R |

(Continued)

OTHER PUBLICATIONS

Amir Mujezinovic, "Bigger Blades Cut Costs", Modern Power Systems, Feb. 2003, p. 25, 27.

(Continued)

*Primary Examiner* — Cheung Lee

(74) *Attorney, Agent, or Firm* — Hoffman Warnick LLC; Ernest Cusick

(57) ABSTRACT

A dovetail for a steam turbine rotating blade and rotor wheel is provided. The dovetail design comprises a rotating blade curved axial entry dovetail having a four hook profile and a rotor wheel dovetail slot sized to receive the blade dovetail. The blade dovetail and wheel dovetail slot each comprise a plurality of slanted crush surfaces, a plurality of non-contact surfaces, and a plurality of necks that each provide a transition between a slanted crush surface to a non-contact surface. Each neck comprises a slant angle defined by the transition of the slanted crush surface to the non-contact surface. The slant angle ranges from about 60 degrees to about 82 degrees.

13 Claims, 7 Drawing Sheets

U.S. PATENT DOCUMENTS

| | | | |
|---|---|---|---|
| 2009/0022601 | A1 | 1/2009 | Slepski et al. |
| 2010/0021306 | A1 | 1/2010 | Mujezinovic et al. |
| 2010/0061861 | A1 | 3/2010 | Riaz et al. |
| 2010/0092295 | A1 | 4/2010 | Riaz et al. |

OTHER PUBLICATIONS

Michael Boss, "Steam Turbine Technology Heats Up", PEI Magazine, Apr. 2003, p. 77, 79, 81.

Riaz et al., "Dovetail Attachment for Use With Turbine Assemblies and Methods of Assembling Turbine Assemblies," U.S. Appl. No. 11/941,751, filed Nov. 16, 2007, Patent Application, 16 pages.

Slepski et al., "Steam Turbine Rotating Blade," U.S. Appl. No. 11/778,180, filed Jul. 16, 2007, Patent Application, 11 pages.

Demania et al., "Low Pressure Section Steam Turbine Bucket," U.S. Appl. No. 12/037,346, filed Feb. 26, 2008, Patent Application, 15 pages.

Clark, Notice of Allowance and Fee(s) Due for U.S. Appl. No. 12/205,938 dated Aug. 23, 2011, 12 pages.

Clark, Notice of Allowance and Fee(s) Due for U.S. Appl. No. 12/205,937 dated Aug. 23, 2011, 13 pages.

* cited by examiner

DOVETAIL FOR STEAM TURBINE ROTATING BLADE AND ROTOR WHEEL

CROSS REFERENCE TO RELATED APPLICATIONS

This patent application relates to commonly-assigned U.S. patent applications Ser. No. 12/205,937 entitled "STEAM TURBINE ROTATING BLADE FOR A LOW PRESSURE SECTION OF A STEAM TURBINE ENGINE" and Ser. No. 12/205,938 entitled "STEAM TURBINE ROTATING BLADE FOR A LOW PRESSURE SECTION OF A STEAM TURBINE ENGINE", all filed concurrently with this application.

BACKGROUND OF THE INVENTION

The present invention relates generally to a steam turbine and more particularly to a dovetail assembly for attaching a steam turbine rotating blade to a steam turbine rotor wheel.

Generally steam turbine rotating blades and steam turbine rotor wheels in the latter stages of a low pressure turbine are usually highly stressed during operation due to large centrifugal loads applied by the rotation of longer and heavier latter stage blades. In particular, large centrifugal loads are placed on the blades due to the high rotational speed of the rotor wheels which in turn stress the blades. These loads induce higher average and local stresses in the connective dovetails that attach the blades to the rotor wheels. These stresses along with moisture from the steam flow path of the steam turbine drive stress corrosion cracking. Both the higher average and local stresses concentrations can lead to lower fatigue life and stress corrosion of turbine rotor wheels and blade dovetails. Reducing stress concentrations and stress corrosion cracking in the dovetails under large centrifugal loads is a design challenge for steam turbine manufacturers, especially as the demand for longer blades increases.

BRIEF DESCRIPTION OF THE INVENTION

In one aspect of the present invention, a dovetail for a steam turbine is provided. The dovetail comprises a rotating blade curved axial entry dovetail having a four hook profile and a turbine rotor wheel dovetail slot sized to receive the blade dovetail. The blade dovetail and wheel dovetail slot each comprise a plurality of slanted crush surfaces, a plurality of non-contact surfaces, and a plurality of necks that each provide a transition between a slanted crush surface and a non-contact surface. Each neck comprises a slant angle defined by the transition of the slanted crush surface to the non-contact surface. The slant angle ranges from about 60 degrees to about 82 degrees.

In another aspect of the present invention, a steam turbine is provided. The steam turbine comprises a plurality of steam turbine blades arranged about a rotor wheel. The plurality of steam turbine blades each comprises an airfoil portion and a curved axial entry dovetail section having a four hook profile. The rotor wheel comprises a plurality of dovetail slots sized to receive a respective blade dovetail section. Each blade dovetail section and wheel dovetail slot comprises a plurality of slanted crush surfaces, a plurality of non-contact surfaces, and a plurality of necks defined by a transition between a slanted crush surface to a non-contact surface. Each neck comprises a slant angle defined by the transition of the slanted crush surface to the non-contact surface. The slant angle ranges from about 60 degrees to about 82 degrees.

DETAILED DESCRIPTION OF THE INVENTION

At least one embodiment of the present invention is described below in reference to its application in connection with and operation of a steam turbine engine. Further, at least one embodiment of the present invention is described below in reference to a nominal size and including a set of nominal dimensions. However, it should be apparent to those skilled in the art and guided by the teachings herein that the present invention is likewise applicable to any suitable turbine and/or engine. Further, it should be apparent to those skilled in the art and guided by the teachings herein that the present invention is likewise applicable to various scales of the nominal size and/or nominal dimensions.

Figure 1:
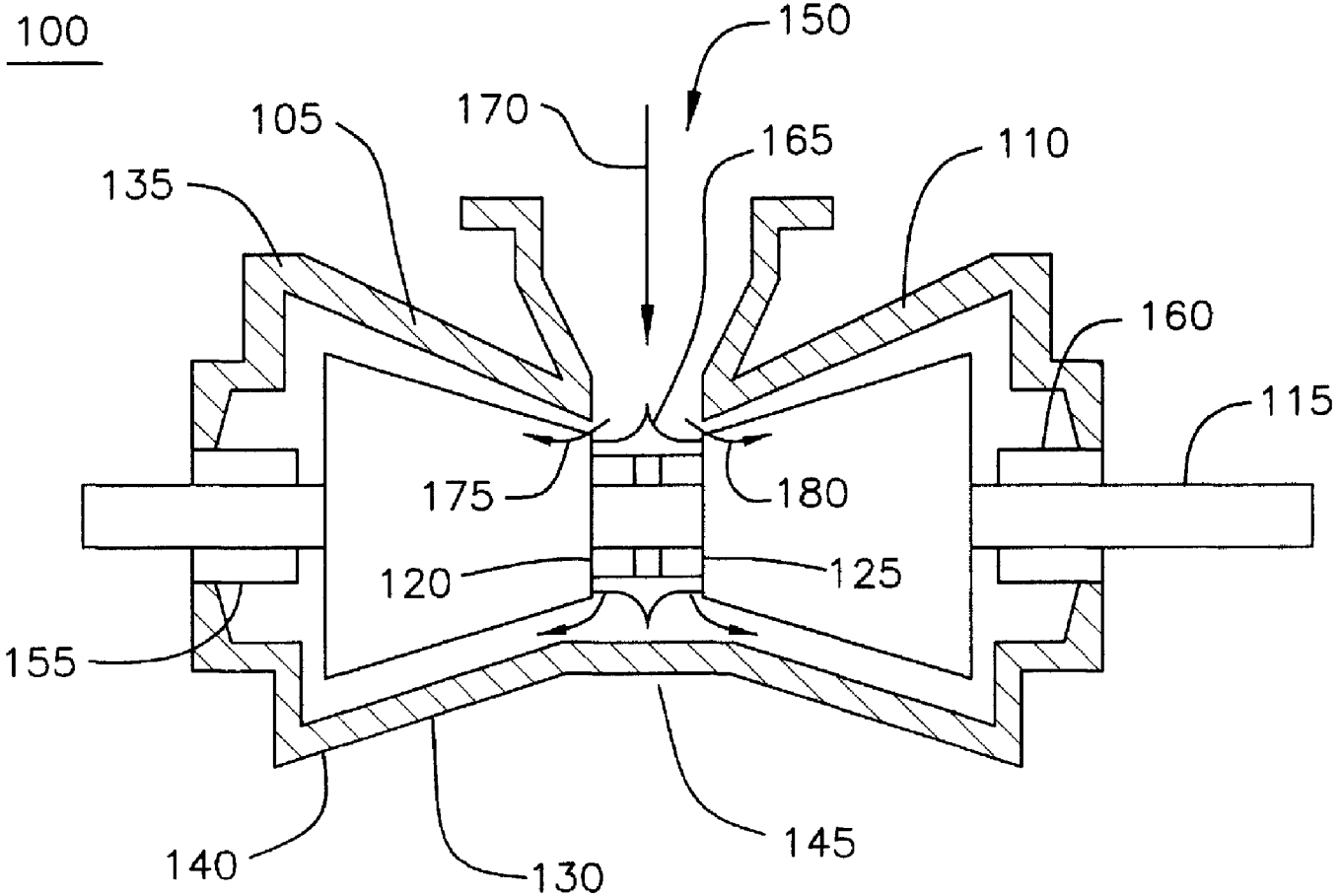
FIG. 1 is a schematic diagram of an exemplary opposed-flow steam turbine engine.

Referring to the drawings, FIG. 1 shows a schematic diagram of an exemplary opposed-flow steam turbine engine 100. Turbine 100 includes a first low pressure (LP) section 105 and a second LP section 110. As is known in the art, each LP section 105 and 110 includes a plurality of stages of diaphragms (not shown in FIG. 1). In one embodiment of the present invention, each LP section 105 and 110 comprises five stages. The five stages are referred to as L0, L1, L2, L3 and L4. The L4 stage is the first stage and is the smallest (in a radial direction) of the five stages. The L3 stage is the second stage and is the next stage in an axial direction. The L2 stage is the third stage and is shown in the middle of the five stages. The L1 stage is the fourth and next-to-last stage. The L0 stage is the last stage and is the largest (in a radial direction). It is to be understood that five stages are shown as one example only, and LP sections 105 and 110 can have more or less than five stages.

A rotor shaft 115 extends through LP sections 105 and 110. Each LP section 105 and 110 includes a nozzle 120 and 125, respectively. A single outer shell or casing 130 is divided along a horizontal plane and axially into upper and lower half sections 135 and 140, respectively, and spans both LP sections 105 and 110. A central section 145 of shell 130 includes a low pressure steam inlet 150. Within outer shell or casing 130, LP sections 105 and 110 are arranged in a single bearing span supported by journal bearings 155 and 160. A flow splitter 165 extends between LP sections 105 and 110.

During operation, low pressure steam inlet 150 receives low pressure/intermediate temperature steam 170 from a source, such as, but not limited to, a high pressure (HP) turbine or an intermediate (IP) turbine through a cross-over pipe (not shown). Steam 170 is channeled through inlet 150 wherein flow splitter 165 splits the steam flow into two opposite flow paths 175 and 180. More specifically, in the exemplary embodiment, steam 170 is routed through LP sections 105 and 110 wherein work is extracted from the steam to rotate rotor shaft 115. The steam exits LP sections 105 and 110 where it is routed for further processing (e.g., to a condenser).

It should be noted that although FIG. 1 illustrates an opposed-flow, LP turbine, as will be appreciated by one of ordinary skill in the art, the present invention is not limited to being used only with LP turbines and can be used with any opposed-flow turbine including, but not limited to, IP turbines and/or HP turbines. In addition, the present invention is not limited to only being used with opposed-flow turbines, but rather may also be used with other turbines (e.g., single flow steam turbines).

Figure 2:
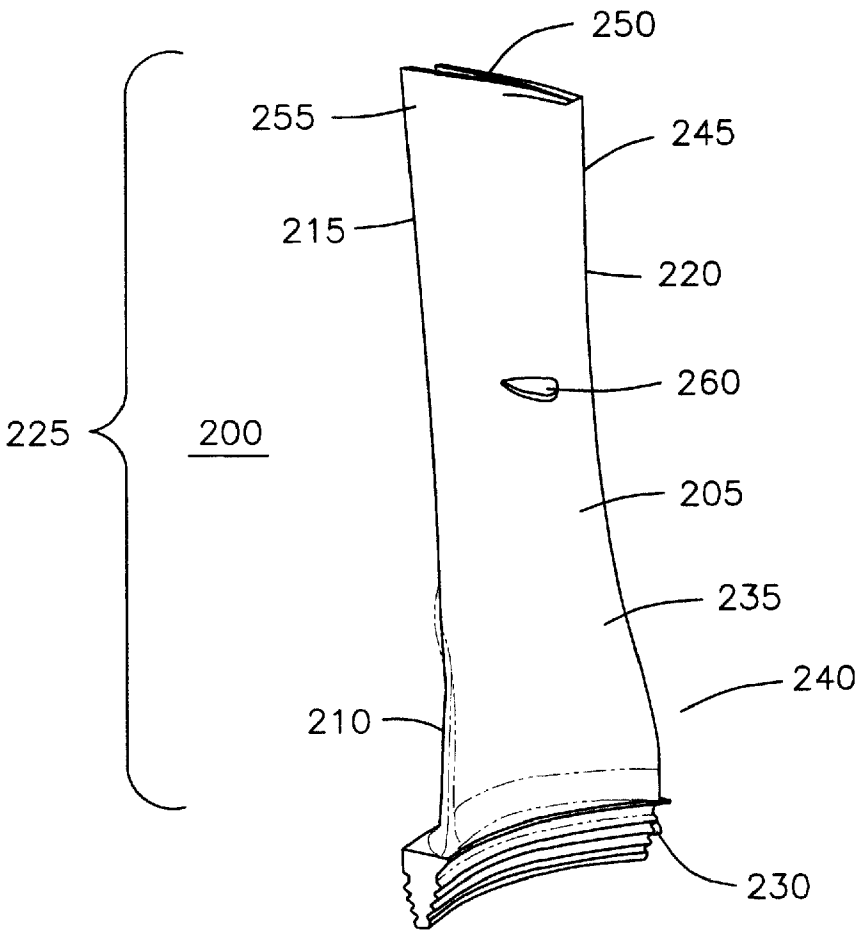
FIG. 2 is an illustration of a rotating blade that may be used with the steam turbine shown in FIG. 1 according to one embodiment of the present invention.

FIG. 2 shows an illustration of a rotating blade 200 that may be used with steam turbine 100 shown in FIG. 1 according to one embodiment of the present invention. In an exemplary embodiment, blade 200 is preferably used in a latter stage (e.g., an L0 stage) of LP sections 105 and 110 (shown FIG. 1). Blade 200 includes a pressure side 205 and a suction side 210 connected together at a leading edge 215 and a trailing edge 220. A blade chord distance is a distance measured from trailing edge 220 to leading edge 215 at any point along a radial length 225. In an exemplary embodiment, radial length 225 or blade length is approximately about 45 inches (114.3 centimeters). Although the description that follows is directed to a blade length of 45 inches (114.3 centimeters), those skilled in the art will appreciate that the teachings herein are applicable to various scales of this nominal size. Blade 200 is formed with a blade dovetail section 230, an airfoil portion 235, and a root section 240 extending therebetween. Airfoil portion 235 extends radially outward from root section 240 to a tip section 245. A cover 250 is integrally formed as part of tip section 245 with a fillet radius 255 located at a transition therebetween. A part span shroud 260 is attached at an intermediate section of airfoil portion 235 between root section 240 and tip section 245. In an exemplary embodiment, blade dovetail section 230, airfoil portion 235, root section 240, tip section 245, cover 250 and part span shroud 260 are all fabricated as a unitary component from a high strength Titanium alloy material having excellent corrosion resistance (e.g., Ti-62222).

Figure 3:
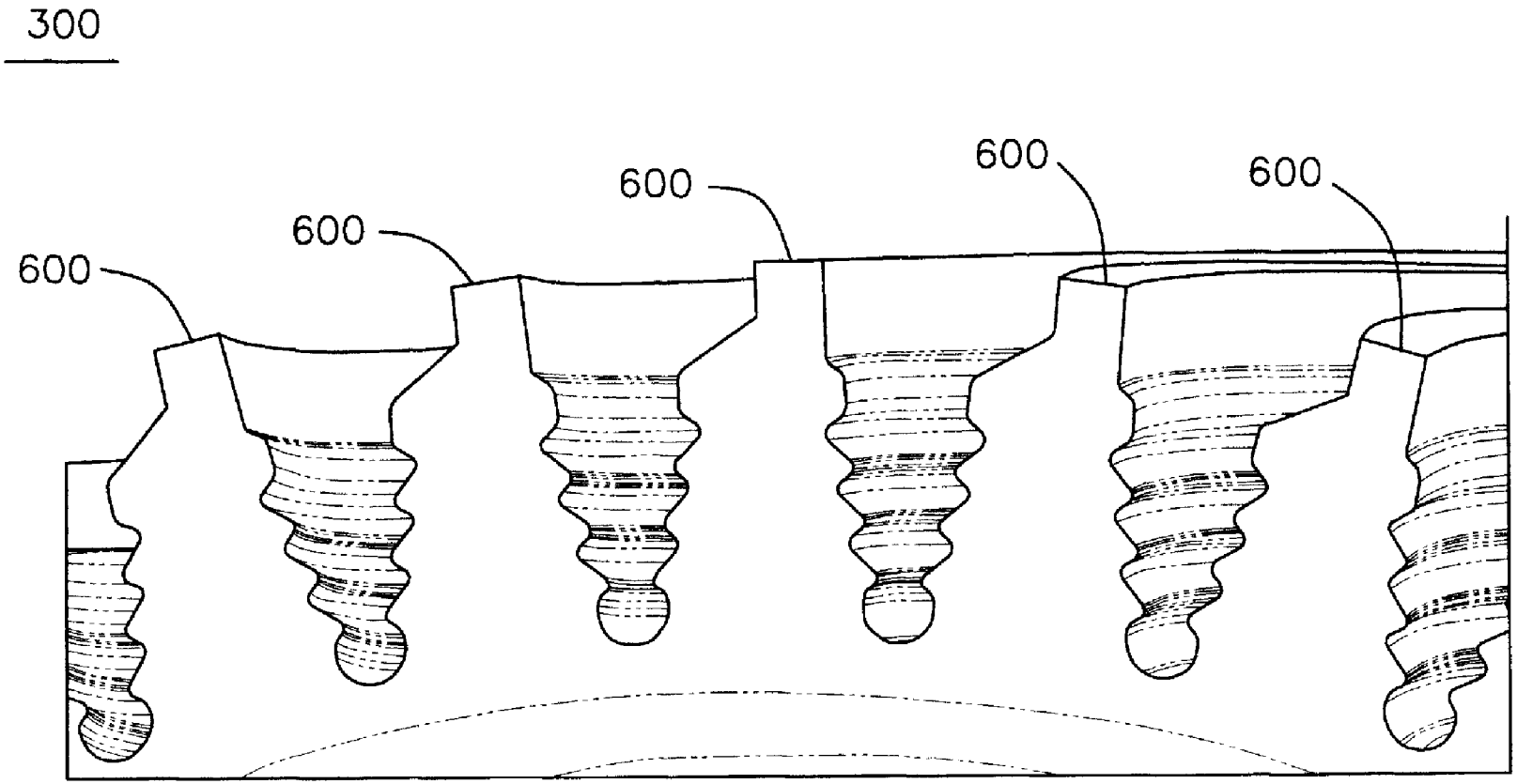
FIG. 3 is a perspective illustration of a portion of a turbine rotor wheel that may be used with the rotating blade shown in FIG. 2 according to one embodiment of the present invention.

In one embodiment, rotating blade 200 is coupled to a rotor wheel via blade dovetail section 230. FIG. 3 shows a perspective illustration of a portion of a rotor wheel 300 that may be coupled to rotating blade 200 according to one embodiment of the present invention. Rotor wheel 300 includes a plurality of circumferentially-aligned dovetail slots 600. In particular, wheel dovetail slots 600 are spaced circumferentially about a radially outer periphery of rotor wheel 300 and are shaped and sized to receive an attachment portion therein, such as blade dovetail section 230 (shown in FIG. 2). More specifically, blades 200 are removably coupled within each wheel dovetail slot 600 by each respective blade dovetail section 230. As such, blades 200 are operatively coupled to shaft 115 (shown in FIG. 1) via wheel 300.

Figure 4:
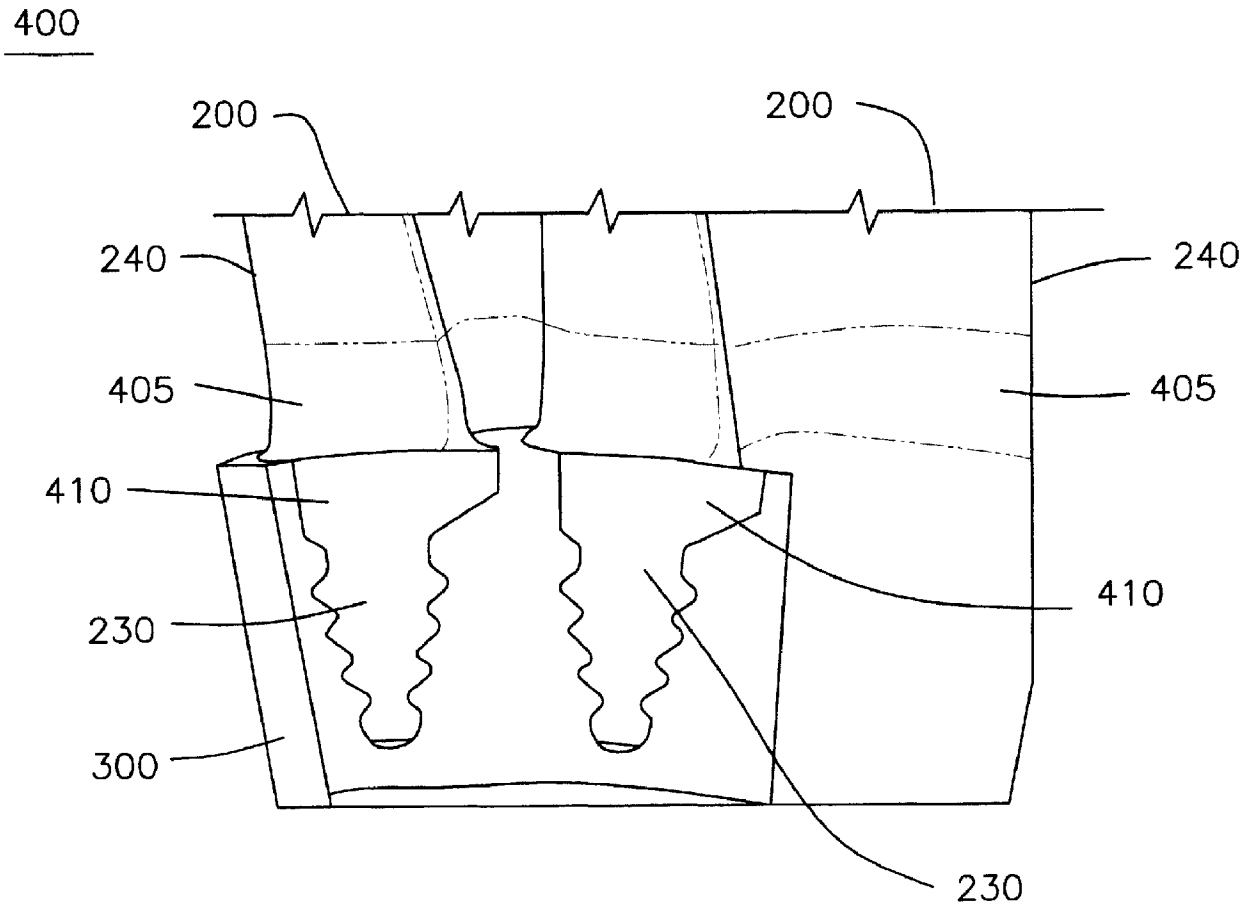
FIG. 4 is a schematic side view showing the attachment of rotating blades like the one shown in FIG. 2 to the turbine rotor wheel shown in FIG. 3 according to one embodiment of the present invention.

FIG. 4 is a schematic side view showing the attachment 400 of rotating blades 200 to the turbine rotor wheel 300 shown in FIG. 3 according to one embodiment of the present invention. As shown in FIG. 4, each blade 200 couples to rotor wheel 300 via wheel dovetail slots configured to mate or engage with blade dovetail sections 230. Typically large centrifugal loads are placed on blades 200 due to the high rotational speed of rotor wheel 300 which in turn stresses the blades. These loads induce higher average and local stresses in the blade dovetail sections 230 and wheel dovetail slots of the rotor wheel 300 through contact or crush surfaces. As explained below in more detail according to one embodiment of the present invention, the geometry and dimensions of blade dovetail sections 230 and wheel dovetail slots of the rotor wheel 300 minimize average and local stresses in both the blade dovetail sections 230 and wheel dovetail slots of the rotor wheel 300 that are caused by large centrifugal loads from the rotating blades. With this optimized design, blade dovetail sections 230 and wheel dovetail slots balance stress between pressure and suction sides of blades 200 and minimize stress concentration areas. In addition, this design is capable of operating at 3600 revolutions per minute (rpm) and is capable of meeting over-speed conditions and low cycle fatigue (LCF) requirements. Although this design is capable of operating at 3600 rpms, those skilled in the art will appreciate that the teachings herein associated with the design are applicable to various scales of this nominal design dimension. For example, for scale factors such as 1.2, 2 and 2.4, the operating speed may be 3000 rpms, 1800 rpms, and 1500 rpms, respectively.

In addition to providing further details of the attachment 400 of rotating blades 200 with wheel dovetail slots of rotor wheel 300, FIG. 4 also shows an enlarged view of a transition area where the blade dovetail sections 230 projects from the root sections 240. In particular, FIG. 4 shows that each blade 200 includes a fillet radius 405 at the location where root section 240 transitions to a platform 410 of dovetail section 230.

Figure 5:
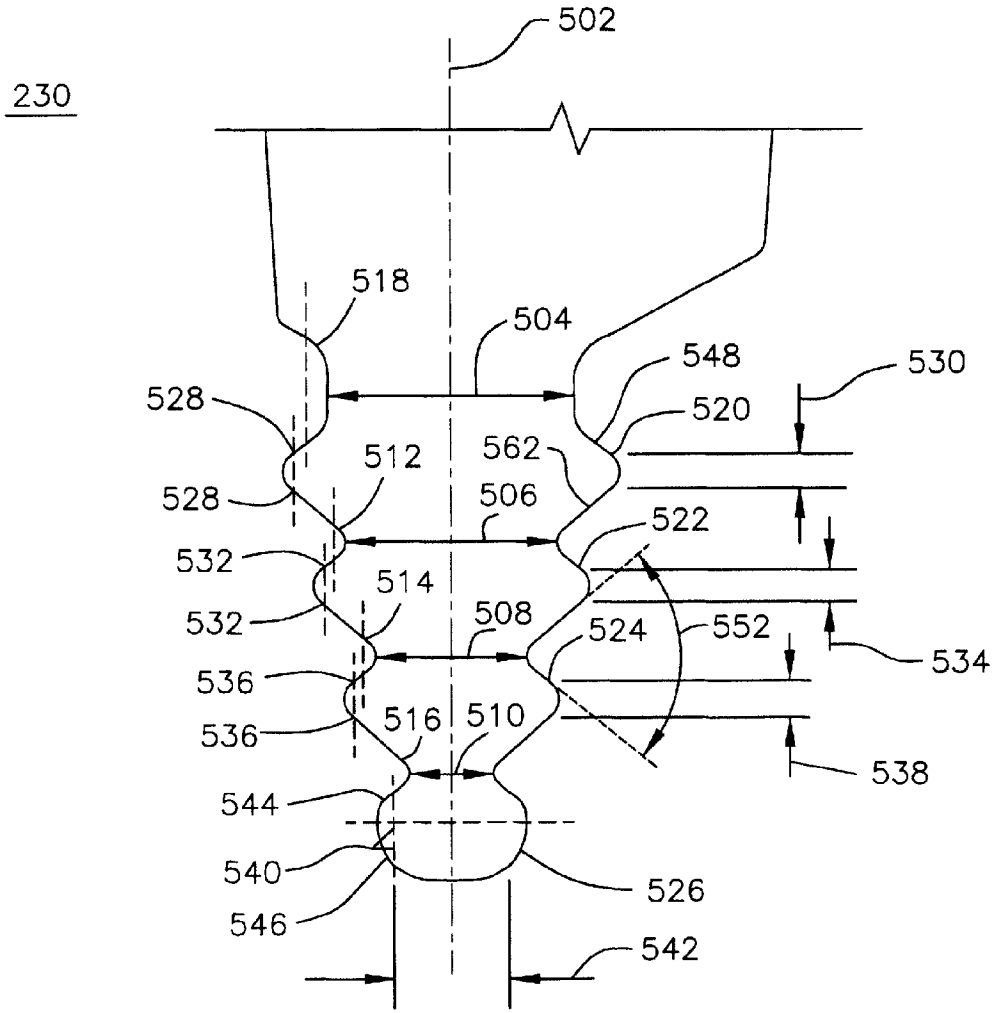
FIG. 5 is a more detailed view of the rotating blade dovetail section shown in the rotating blade of FIG. 2 according to one embodiment of the present invention.

FIG. 5 is a more detailed view of the rotating blade dovetail section 230 shown in the rotating blade of FIG. 2 according to one embodiment of the present invention. As shown in FIG. 5, blade dovetail section 230 is a curved axial entry dovetail having a four hook profile with eight contact surfaces that engage with the wheel dovetail slots to carry the centrifugal pull loads associated with the rotating blade. Although the description that follows is directed to a dovetail with four hooks, those skilled in the art will recognize that this curved axial entry dovetail can have more or less than four hooks.

In an exemplary embodiment, dovetail section 230 is symmetric about a radial centerline 502. Alternative embodiments may alter the location of each element described below in relation to centerline 502. Dovetail section 230 includes a plurality of necks 504, 506, 508, and 510. Specifically, in the exemplary embodiment, dovetail section 230 includes a top neck 504, a first middle neck 506, a second middle neck 508 and a bottom neck 510. First middle neck 506 is formed with a neck fillet radius 512, while second middle neck 508 is formed with a neck fillet radius 514. Similarly, bottom neck 510 is also formed with a neck fillet radius 516 and top neck 504 is formed with a neck fillet radius 518. In an exemplary embodiment, neck fillet radii, 512, 514 and 516 are identical, wherein each measures between about 2.60 millimeters (0.10 inches) and about 6.24 millimeters (0.25 inches) or, more specifically, approximately 2.60 millimeters (0.10 inches). Alternative embodiments may vary the neck fillet radius of each neck, either individually or in common. In the exemplary embodiment, neck fillet radius 518 for top neck 504 measures between about 4.5 millimeters (0.17 inches) and about 10.8 millimeters (0.43 inches) or, more specifically, approximately 4.5 millimeters (0.17 inches). Alternative embodiments may use a different neck fillet radius for radius 518 of top neck 504. In the exemplary embodiment, note that neck fillet radius 518 is larger than neck fillet radii 512, 514 and 516 to allow a smooth transition with blade dovetail section platform 415. In this exemplary embodiment, the above-noted measurements for neck fillet radii 512, 514, 516 and 518 have been selected to reduce local stress concentrations in dovetail section 230 for this particular application, however, those skilled in the art will recognize that these measurements can be varied for the desired application of the dovetail assembly.

As shown in FIG. 5, dovetail section 230 also includes a plurality of hooks 520, 522, 524 and 526. Specifically, dovetail section 230 includes a top hook 520, a first middle hook 522, a second middle hook 524, and a bottom hook 526. Top hook 520 is formed with two identical radii 528 and a flat surface 530 extending therebetween. First middle hook 522 is also formed with two identical radii 532 and a flat surface 534 extending therebetween and second middle hook 524 is formed with two identical radii 536 and a flat surface 538 extending therebetween. In the exemplary embodiment, radii 528, 532 and 536 are identical and each measures between about 1.270 millimeters (0.05 inches) and about 3.048 millimeters (0.3408 inches) or, more specifically, approximately 1.270 millimeters (0.05 inches). Alternative embodiments may vary the radius of each hook, either individually or in common. Similarly, those skilled in the art will appreciate that these nominal dimensions can be scaled according to various scale factors.

Bottom hook 526 is formed with a compound radius 540 and a flat surface 542 that defines the bottom surface of dovetail 230. In the exemplary embodiment, compound radius 540 includes two radii 544 and 546. In the exemplary embodiment, radius 544 measures between about 2.530 millimeters (0.01 inches) and about 6.072 millimeters (0.24 inches) or, more specifically, approximately 2.530 millimeters (0.01 inches). Radius 546 measures between about 8.050 millimeters (0.32 inches) and about 19.32 millimeters (0.76 inches) or, more specifically, approximately 8.050 millimeters (0.32 inches). Alternative embodiments may include different radius measurements and/or may include bottom hook 526 including only a single radius.

Figure 6:
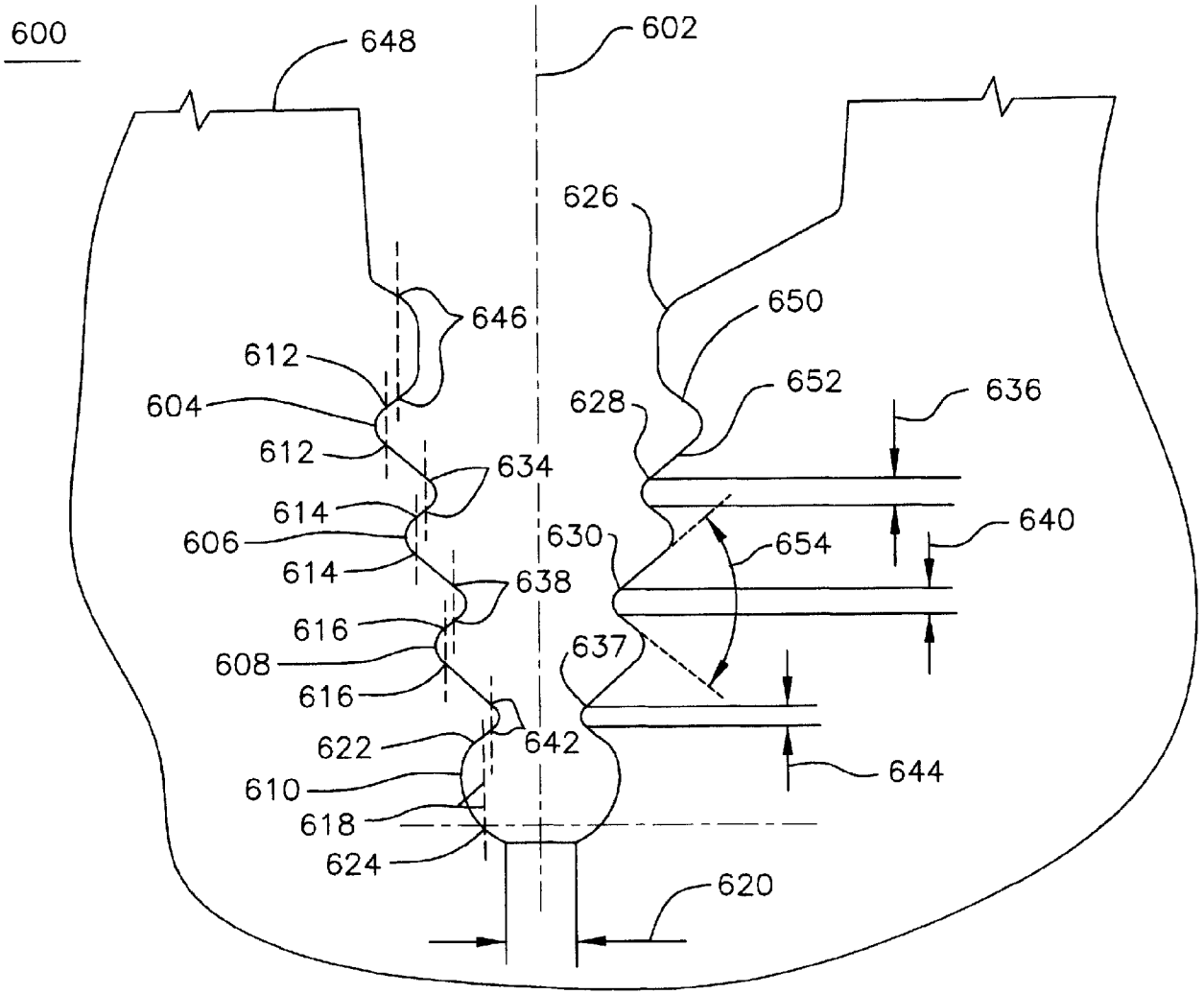
FIG. 6 is a more detailed view of the turbine rotor wheel dovetail slot shown in the rotor wheel of FIG. 3 according to one embodiment of the present invention.

FIG. 6 is a more detailed view of the turbine rotor wheel dovetail slot 600 shown in the rotor wheel of FIG. 3 according to one embodiment of the present invention. In the exemplary embodiment, wheel dovetail slot 600 is symmetric about centerline 602 and is shaped complementary to engage blade dovetail section 230 (shown in FIG. 5). Alternative embodiments may alter the location of each element described below in relation to centerline 602. Slot 600 includes a plurality of necks 604, 606, 608 and 610. Specifically, in the exemplary embodiment, slot 600 includes a top neck 604, a first middle neck 606, a second middle neck 608 and a bottom neck 610. Top neck 604 is formed with a radius 612, first middle neck 606 is formed with a radius 614 and second middle neck 608 is formed with a radius 616. In the exemplary embodiment, radii 612, 614 and 616 are identical and each measures between about 3.0 millimeters (0.12 inches) and about 7.2 millimeters (0.28 inches) or, more specifically, approximately 3.0 millimeters (0.12 inches). Alternative embodiments may vary neck 604, 606 and/or 608. Bottom neck 610 is formed with a compound radius 618 and a flat surface 620 that defines the bottom surface of slot 600. In the exemplary embodiment, compound radius 618 includes two radii 622 and 624. Specifically, in the exemplary embodiment, radius 622 measures between about 3.0 millimeters (0.12 inches) and about 7.2 millimeters (0.28 inches) or, more specifically, approximately 3.0 millimeters (0.12 inches). Radius 624 measures between about 11.0 millimeters (0.43 inches) and about 26.4 millimeters (1.04 inches) or, more specifically, approximately 11.0 millimeters (0.43 inches). Alternative embodiments may include different radius measurements or may include bottom neck 610 including only a single radius.

In this exemplary embodiment, slot 600 also includes a plurality of hooks 626, 628, 630, and 632. Specifically, in the exemplary embodiment, slot 600 includes a top hook 626, a first middle hook 628, a second middle hook 630 and a bottom hook 632. First middle hook 628 is formed with two identical radii 634 and a flat surface 636 extending therebetween. In the exemplary embodiment, each radius 634 measures between about 1.27 millimeters (0.05 inches) and about 3.05 millimeters (0.12 inches) or, more specifically, approximately 1.27 millimeters (0.05 inches). Further, alternative embodiments may use a different radius or may use two different radii. As shown in FIG. 6, second middle hook 630 is formed with two identical radii 638 and a flat surface 640 extending therebetween. In the exemplary embodiment, each radius 638 measures between about 1.27 millimeters (0.05 inches) and about 3.05 millimeters (0.12 inches) or, more specifically, approximately 1.27 millimeters (0.05 inches). Further, alternative embodiments may use a different radius or may use two different radii.

Bottom hook 632 is formed with two identical radii 642 and a flat surface 644 extending therebetween. In the exemplary embodiment, each radius 632 measures between about 1.27 millimeters (0.05 inches) and about 3.05 millimeters (0.12 inches) or, more specifically, approximately 1.27 millimeters (0.05 inches). Further, alternative embodiments may use a different radius or may use two different radii. First middle hook 628, second middle hook 630 and bottom hook 632 are shaped to facilitate carrying load approximately equally. Top hook 626 includes a radius 646 which, in the exemplary embodiment, measures between about 6.10 millimeters (0.24 inches) and about 14.64 millimeters (0.58 inches) or, more specifically, approximately 6.10 millimeters (0.24 inches). Alternative embodiments may use a different radius for top hook 626. Radius 646 is selected to facilitate a smooth transition between slot 600 a top wheel surface 648.

In addition to the measurements provided above for the neck radii and hook for the dovetail section 230 and wheel dovetail slot 600, other measurements of interest are the hook thicknesses and the neck lengths. The hook thickness and neck length controls the load sharing between hooks as well as the bending and shear stiffness/stresses in the hook. All of this contributes to the degree of concentrated stress and strain. Therefore, in an exemplary embodiment, the hook thickness and neck length are optimized to minimize local and average stresses.

In the exemplary embodiment, and as shown in FIGS. 5 and 6, dovetail section 230 and slot 600 each includes a plurality of crush surfaces 548 and 650 and non-contact surfaces 562 and 652, respectively. Specifically, in the exemplary embodiment, dovetail section 230 includes a plurality of crush surfaces 548 and a plurality of non-contact surfaces 562. More specifically, each crush surface 548 is oriented on an axial-circumferential plane and is defined by a transition defined between a neck radii 512, 514, 516 and/or 518, and a respective hook 520, 522, 524 and/or 526. Each non-contact surface 562 is similarly defined by a transition defined between a hook 520, 522, 524 and/or 526 and a respective neck radius 512, 514, 516 and/or 518. Slot 600 is also formed with a plurality of crush surfaces 650 and a plurality of non-contact surfaces 652. Specifically, each crush surface 650 is oriented on an axial-circumferential plane and is defined by a transition defined between a hook 626, 628, 630 and/or 632 and a neck 604, 606, 608 and/or 610. Each non-contact surface 652 is defined by a transition defined between a neck 604, 606, 608 and/or 610 and respective a hook 626, 628, 630 and/or 632. In the exemplary embodiment, each crush surface 548 and 650 is oriented such that a transition angle 552 and 654 defined between a crush surface 548 and 650 and a non-contact surface 562 and 652 measures between about 60.0° and 90.0° or, more specifically, approximately 80.5°. Such a transition angle is known as the slant angle. Those skilled in the art will appreciate that these nominal dimensions can be scaled according to various scale factors.

Figure 7:
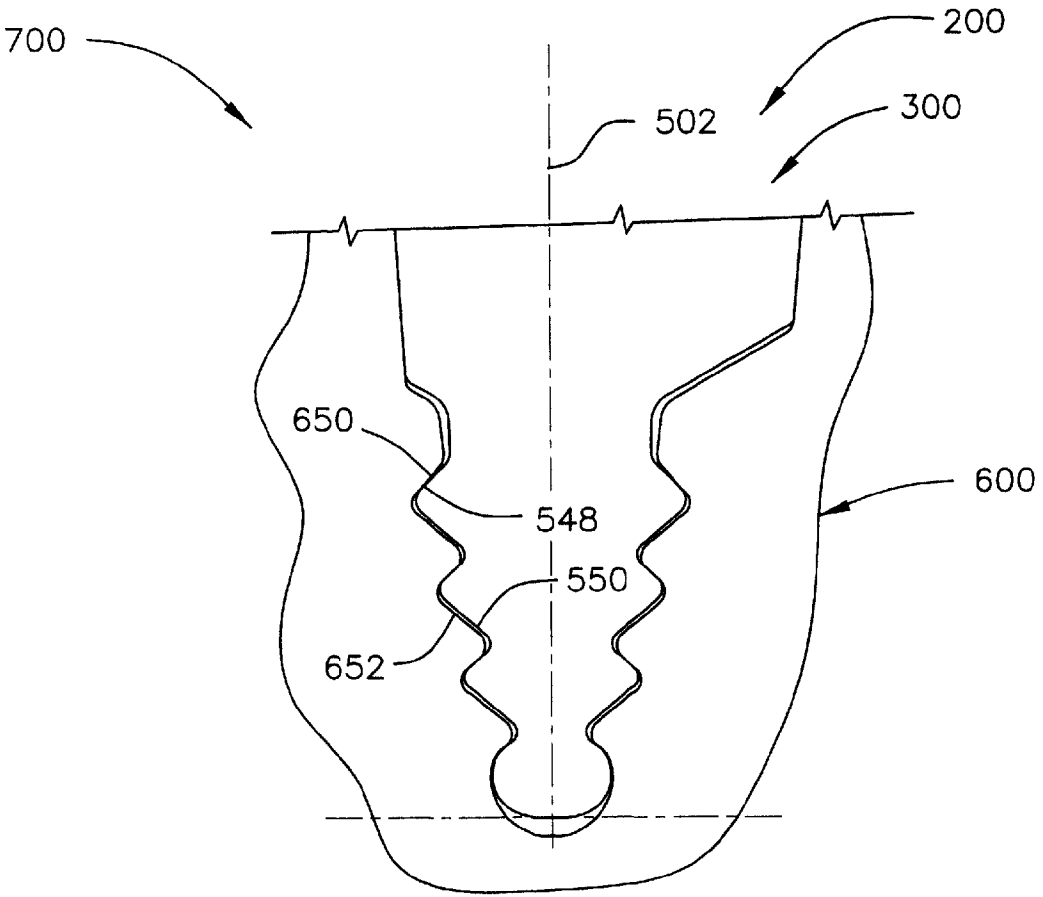
FIG. 7 is a schematic diagram showing the dovetail assembly of the blade dovetail section shown in FIG. 5 with the wheel dovetail slot shown in FIG. 6 according to one embodiment of the present invention.

FIG. 7 is a schematic diagram showing the dovetail assembly of the blade dovetail section 230 shown in FIG. 5 and the wheel dovetail slot 600 shown in FIG. 6 according to one embodiment of the present invention. More specifically, FIG. 7 illustrates the relationship between crush surfaces 548 and 650 of bucket dovetail section 230 and wheel dovetail slot 600, respectively. Moreover, FIG. 7 illustrates the relationship between non-contact surfaces 562 and 652 of dovetail section 230 and wheel dovetail slot 600, respectively.

During operation, rotation of wheel 300 causes centrifugal forces to develop in blades 200, which are then transferred to each dovetail assembly 700 through crush surfaces 548 and 650. Such forces induce stresses in each dovetail assembly 700. Concentrated stress loading results when load paths are forced to change direction. With a slanted crush surface, such as crush surfaces 548 and 650, the change in direction is less severe and, as such, the resulting stress concentration is reduced. Additionally, a slant angle, such as slant angle 552 and 654, permits a larger fillet radius in the same transition, further reducing stress concentration. Predetermined radius values in the hook 520, 522, 524, 526, 626, 628, 630 and/or 632 and neck 512, 514, 516, 518, 604, 606, 608 and/or 610 further mitigate stresses caused by the centrifugal forces generated by rotor wheel 300 by allocating in a more equal fashion the stresses on each of the hook and neck fillets.

The aforementioned dovetail assembly facilitates minimizing local stresses in blade and wheel necks caused by the high centrifugal force induced to blades. An optimized slant angle and optimized fillet radii facilitate uniformly distributing the load on the dovetail assembly, thereby resulting in low local and average stresses in both the blade dovetail and the wheel dovetail slot. Such a reduction in stress concentration facilitates carrying higher centrifugal loads giving improved power output Blade dovetail section 230 and wheel dovetail slot 600 according to aspects of the present invention is preferably suited for use in an L0 stage of a low pressure section of a steam turbine. However, the dovetail assembly of blade dovetail section 230 and wheel dovetail slot 600 could also be used in other stages or other sections (e.g., high or intermediate) as well.

Furthermore, even though exemplary embodiments of the dovetail assembly of blade dovetail section 230 and wheel dovetail slot 600 have been described with reference to minimizing local stresses in a dovetail assembly of a steam turbine, those skilled in the art will recognize that aspects of the present invention are not limited to the specific embodiments described herein, but rather, may be utilized independently and separately within other applications. For example, dovetail assembly of blade dovetail section 230 and wheel dovetail slot 600 may also be fabricated and/or used in combination with other industrial plant or component design and/or monitoring systems and methods, and is not limited to practice with only power plants generically or to steam turbine engines specifically, as described herein. Rather, aspects of the present invention can be implemented and utilized in connection with many other component or plant designs and/or systems.

While the disclosure has been particularly shown and described in conjunction with a preferred embodiment thereof, it will be appreciated that variations and modifications will occur to those skilled in the art. Therefore, it is to be understood that the appended claims are intended to cover all such modifications and changes as fall within the true spirit of the disclosure.

What is claimed is:

1. A dovetail for a steam turbine, comprising a rotating blade curved axial entry dovetail having a four hook profile and a rotor wheel dovetail slot sized to receive the blade dovetail, the blade dovetail and wheel dovetail slot each comprising a plurality of slanted crush surfaces, a plurality of non-contact surfaces, and a plurality of necks that each provide a transition between a slanted crush surface and a non-contact surface, wherein each neck comprises a slant angle defined by the transition of the slanted crush surface to the non-contact surface, wherein the slant angle ranges from about 62 degrees to about 90 degrees, the blade dovetail and wheel dovetail slot each further comprising: a plurality of hooks defined by a transition between a slanted crush surface to a non-contact surface, wherein each hook projects outward from a neck, the plurality of hooks of the blade dovetail and wheel dovetail slot each comprising a top hook, a first middle hook, a second middle hook and a bottom hook, the top hook and the first and second middle hooks of the blade dovetail are formed with two radii and a flat surface extending therebetween, wherein the two radii for the top hook are identical with each other, the two radii for the first middle hook are identical with each other and the two radii for the second middle hook are identical with each other, and wherein the radii of the top hook, first middle hook and second middle hook are all identical with each other.

2. The dovetail according to claim 1, wherein the plurality of necks of the blade dovetail and wheel dovetail slot comprises a top neck, a first middle neck, a second middle neck and a bottom neck.

3. The dovetail according to claim 1, wherein the top neck, first middle neck, second middle neck and bottom neck of the blade dovetail are each formed from a radius, wherein the radius for the first and second middle necks and the bottom neck are larger than the radius used to form the top blade neck.

4. The dovetail according to claim 1, wherein the top neck, first and second middle necks and bottom neck of the wheel dovetail slot are each formed from a radius, wherein the radius for the top neck and the first and second middle necks are substantially similar and the bottom neck is formed from a compound radius and a flat surface that defines a bottom surface of the wheel dovetail slot.

5. The dovetail according to claim 1, wherein each of the plurality of necks of the blade dovetail comprises a neck fillet that has a radius that ranges from about 2.60 millimeters (0.10 inches) to about 6.24 millimeters (0.25 inches).

6. The dovetail according to claim 1, wherein each of the plurality of necks of the wheel dovetail slot comprises a neck fillet that has a radius that ranges from about 3.0 millimeters (0.12 inches) to about 7.2 millimeters (0.28 inches).

7. The dovetail according to claim 1, wherein the bottom hook of the blade dovetail is formed with a compound radius and a flat surface that defines a bottom surface of the dovetail.

8. The dovetail according to claim 1, wherein each of the plurality of hooks of the blade dovetail comprises a hook fillet that has a radius that ranges from about 1.270 millimeters (0.05 inches) to about 3.048 millimeters (0.3408 inches).

9. The dovetail according to claim 1, wherein the top hook, first and second middle hook and bottom hook of the wheel dovetail slot are each formed with two radii and a flat surface extending therebetween.

10. The dovetail according to claim 1, wherein each of the plurality of hooks of the wheel dovetail slot comprises a hook fillet that has a radius that ranges from about 1.270 millimeters (0.05 inches) to about 3.048 millimeters (0.3408 inches).

11. A steam turbine, comprising:

a plurality of steam turbine blades arranged about a rotor wheel, the plurality of steam turbine blades each comprising an airfoil portion and a curved axial entry dovetail section having a four hook profile, the rotor wheel comprising a plurality of dovetail slots sized to receive a respective blade dovetail section, each blade dovetail section and wheel dovetail slot comprises a plurality of slanted crush surfaces, a plurality of non-contact surfaces, and a plurality of necks defined by a transition between a slanted crush surface to a non-contact surface, wherein each neck comprises a slant angle defined by the transition of the slanted crush surface to the non-contact surface, wherein the slant angle ranges from about 62 degrees to about 90 degrees, each blade dovetail section and wheel dovetail slot further comprising: a plurality of hooks defined by a transition between a slanted crush surface to a non-contact surface, wherein each hook projects outward from a neck, the plurality of hooks of each blade dovetail section and wheel dovetail slot comprising a top hook, a first middle hook, a second middle hook and a bottom hook, the top hook and the first and second middle hooks of each blade dovetail section are formed with two radii and a flat surface extending therebetween, wherein the two radii for the top hook are identical with each other, the two radii for the first middle hook are identical with each other and the two radii for the second middle hook are identical with each other, and wherein the radii of the top hook, first middle hook and second middle hook are all identical with each other.

12. The steam turbine according to claim 11, wherein each airfoil portion of the plurality of steam turbine blades has a length of about 114.3 centimeters (45 inches) or greater.

13. The steam turbine according to claim 11, wherein each airfoil of the plurality of steam turbine blades operates as an latter stage blade of a low pressure section of the steam turbine.

* * * * *